US011195417B2

(12) United States Patent
Ji et al.

(10) Patent No.: US 11,195,417 B2
(45) Date of Patent: Dec. 7, 2021

(54) VEHICLE AND METHOD FOR PREDICATING COLLISION

(71) Applicants: HYUNDAI MOTOR COMPANY, Seoul (KR); KIA MOTORS CORPORATION, Seoul (KR)

(72) Inventors: Sungmin Ji, Incheon (KR); Jaewoong Choi, Seoul (KR); Hyungmin Ko, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 149 days.

(21) Appl. No.: 16/696,643

(22) Filed: Nov. 26, 2019

(65) Prior Publication Data

US 2020/0327809 A1 Oct. 15, 2020

(30) Foreign Application Priority Data

Apr. 9, 2019 (KR) ..... 10-2019-0041436

(51) Int. Cl.
*G08G 1/16* (2006.01)
*G08G 1/052* (2006.01)
*G08G 1/01* (2006.01)

(52) U.S. Cl.
CPC ..... *G08G 1/161* (2013.01); *G08G 1/0125* (2013.01); *G08G 1/052* (2013.01); *G08G 1/166* (2013.01)

(58) Field of Classification Search
CPC ..... G08G 1/0125; G08G 1/017; G08G 1/052; G08G 1/161; G08G 1/166
See application file for complete search history.

(56) References Cited

U.S. PATENT DOCUMENTS

2016/0229410 A1* 8/2016 Clarke ..... B60W 30/08
2018/0273031 A1* 9/2018 Fujita ..... G01C 21/3667
2018/0286247 A1* 10/2018 Fujita ..... G05D 1/0246

* cited by examiner

*Primary Examiner* — Sisay Yacob
(74) *Attorney, Agent, or Firm* — Morgan, Lewis & Bockius LLP

(57) ABSTRACT

A vehicle includes: a capturer configured to detect at least one stopped vehicle stopped in a first lane crossing at a right side of a second lane in which the vehicle is located; a detection sensor configured to detect the target vehicle located in a third lane next to the at least one stopped vehicle to obtain position information and speed information of the target vehicle; and a controller configured to determine a first position of the vehicle for sensing the target vehicle between stopped vehicles, determine an expected position to move the target vehicle for a time it takes for the vehicle to move from the first position to a second position, determine a reliability of a possibility of collision between the vehicle and the target vehicle by comparing an actual position and the expected position of the target vehicle.

20 Claims, 6 Drawing Sheets

VEHICLE AND METHOD FOR PREDICATING COLLISION

CROSS-REFERENCE TO RELATED APPLICATION(S)

This application is based on and claims priority to Korean Patent Application No. 10-2019-0041436, filed on Apr. 9, 2019, in the Korean Intellectual Property Office, the disclosure of which is incorporated by reference herein in its entirety.

TECHNICAL FIELD

The present disclosure relates to a vehicle and a method for controlling thereof, and more particularly, to a technology for compensating a cross collision avoidance system through information of a target vehicle obtained through vehicles stopped in a lane intersecting with a driving lane.

BACKGROUND

Vehicles are driven on roads or tracks to transport people or goods to destinations. The vehicles are able to move to various locations on one or more wheels mounted onto a frame of the vehicle. Such vehicles may be classified into three- or four-wheel vehicles, a two-wheel vehicle such as a motorcycle, construction machinery, a bicycle, a train traveling along rails on tracks, and the like.

In modern society, vehicles are the most common transportation means, and people using the vehicles are ever increasing. With the development of automotive technology, there are advantages of moving long distances without much effort, making lives more convenient, etc., but problems also often arise in that traffic conditions worsen and traffic jams become serious where population densities are high.

To relieve burdens and increase convenience of a driver, recent studies regarding vehicles equipped with an Advanced Driver Assist System (ADAS) that actively provides information about a state of the vehicle, a state of the driver, and surrounding conditions are actively ongoing.

As examples of the ADAS equipped within the vehicle, there are Cross Traffic Alert (CTA) and Cross Collision Avoidance (CCA). The Cross Traffic Alert and the Cross Collision Avoidance are collision avoidance systems that determine the risk of collision with an opposing vehicle or a cross vehicle in an intersection driving situation and emergency braking in a collision situation.

The Cross Traffic Alert and the Cross Collision Avoidance serve to detect and avoid collision risks of vehicles, and recently, there is a need for a technique for controlling collision avoidance even when it is not easy to identify a vehicle driving in a side lane is covered by vehicles stopped at an intersection.

SUMMARY

It is an aspect of the present disclosure to prevent a collision by accurately predicting a collision between a vehicle and a target vehicle through information of the target vehicle obtained through vehicles stopped in a lane that intersects with a driving lane.

Additional aspects of the present disclosure will be set forth in part in the description which follows and, in part, will be obvious from the description, or may be learned by practice of the present disclosure.

In accordance with one aspect of the present disclosure, a vehicle includes: a capturer configured to detect at least one stopped vehicle stopped in a first lane crossing at a right side of a second lane in which the vehicle is located; a detection sensor configured to detect a target vehicle driving in a third lane next to the at least one stopped vehicle to obtain position information and speed information of the target vehicle; and a controller configured to determine a first position of the vehicle for sensing the target vehicle between stopped vehicles, determine an expected position to move the target vehicle from an actual position for a time it takes for the vehicle to move from the first position to a second position, and determine a reliability of a possibility of collision between the vehicle and the target vehicle by comparing the actual position and the expected position.

The controller may determine the target vehicle as a collision avoidance target vehicle when a distance between the actual position and the expected position are less than or equal to a predetermined distance.

The controller may not determine the target vehicle as a collision avoidance target vehicle when a distance between the actual position and the expected position exceed a predetermined distance.

The first position is an actual position of the vehicle, and the second position is a position to which the vehicle reaches by moving from the first position for a predetermined time.

The controller may determine the target vehicle as a collision avoidance target vehicle when the target vehicle is detected between stopped vehicles while the vehicle is at the first position or the target vehicle is detected between stopped vehicles while the vehicle is at the second position.

The controller may not determine the target vehicle as a collision avoidance target vehicle when the target vehicle is detected between one stopped vehicles while the vehicle is at the first position and the target vehicle is not detected between stopped vehicles while the vehicle is at the second position.

The controller may further determine an angle between the vehicle and the at least one stopped vehicle.

The controller may further determine a driving speed of the target vehicle.

The controller may determine a number of operations for determining the reliability of the possibility of collision between the vehicle and the target vehicle based on a number of stopped vehicles, and determine the reliability of the possibility of collision between the vehicle and the target vehicle by considering whether a collision avoidance target vehicle is determined according to the number of operations.

The controller may determine a stopped vehicle search area based on the detected lane in which the at least one stopped vehicle is located and the width of the lane next to the at least one stopped vehicle, and determine a number and a position of the at least one stopped vehicle detected in the stopped vehicle search area.

The controller may change a driving control amount of the vehicle based on the reliability of the possibility of collision.

In accordance with another aspect of the present disclosure, a method for controlling a vehicle includes: detecting at least one stopped vehicle stopped in a first lane crossing at a right side of a second lane in which the vehicle is driving; detecting a target vehicle driving in a third lane next to the at least one stopped vehicle to obtain position information and speed information of the target vehicle; determining a first position of the vehicle for sensing the target vehicle between stopped vehicles;

determining an expected position to move the target vehicle from an actual position for a time it takes for the vehicle to move from the first position to a second position; and determining a reliability of a possibility of collision between the vehicle and the target vehicle by comparing the actual position and the expected position.

The method may further include determining the target vehicle as a collision avoidance target vehicle when a distance between the actual position and the expected position is less than or equal to a predetermined distance.

The method may further include not determining the target vehicle as a collision avoidance target vehicle when a distance between the determined position and the determined estimated position exceeds a predetermined distance.

In the determining a first position of the vehicle, the first position is an actual position of the vehicle, and the second position is a position to which the vehicle reaches by moving from the first position for a predetermined time.

The method may further include determining the target vehicle as a collision avoidance target vehicle when the target vehicle is detected between stopped vehicles while the vehicle is at the first position or the target vehicle is detected between stopped vehicles while the vehicle is at the second position.

The method may further include not determining the target vehicle as a collision avoidance target vehicle when the target vehicle is detected between stopped vehicles while the vehicle is at the first position and the target vehicle is not detected between stopped vehicles while the vehicle is at the second position.

The determining a first position of the vehicle may include: determining an angle between the vehicle and the at least one stopped vehicle.

The determining an expected position may include: determining a driving speed of the target vehicle.

The method may further include: determining a number of operations for determining the reliability of the possibility of collision between the vehicle and the target vehicle based on a number of stopped vehicles; and determining the reliability of the possibility of collision between the vehicle and the target vehicle by considering whether a collision avoidance target vehicle is determined according to the number of operations.

The method may further include: determining a stopped vehicle search area based on the first lane i and a width of the third lane next; and determining a number and a position of at least one stopped vehicle detected in the stopped vehicle search area.

The method may further include: changing a driving control amount of the vehicle based on the reliability of the possibility of collision.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
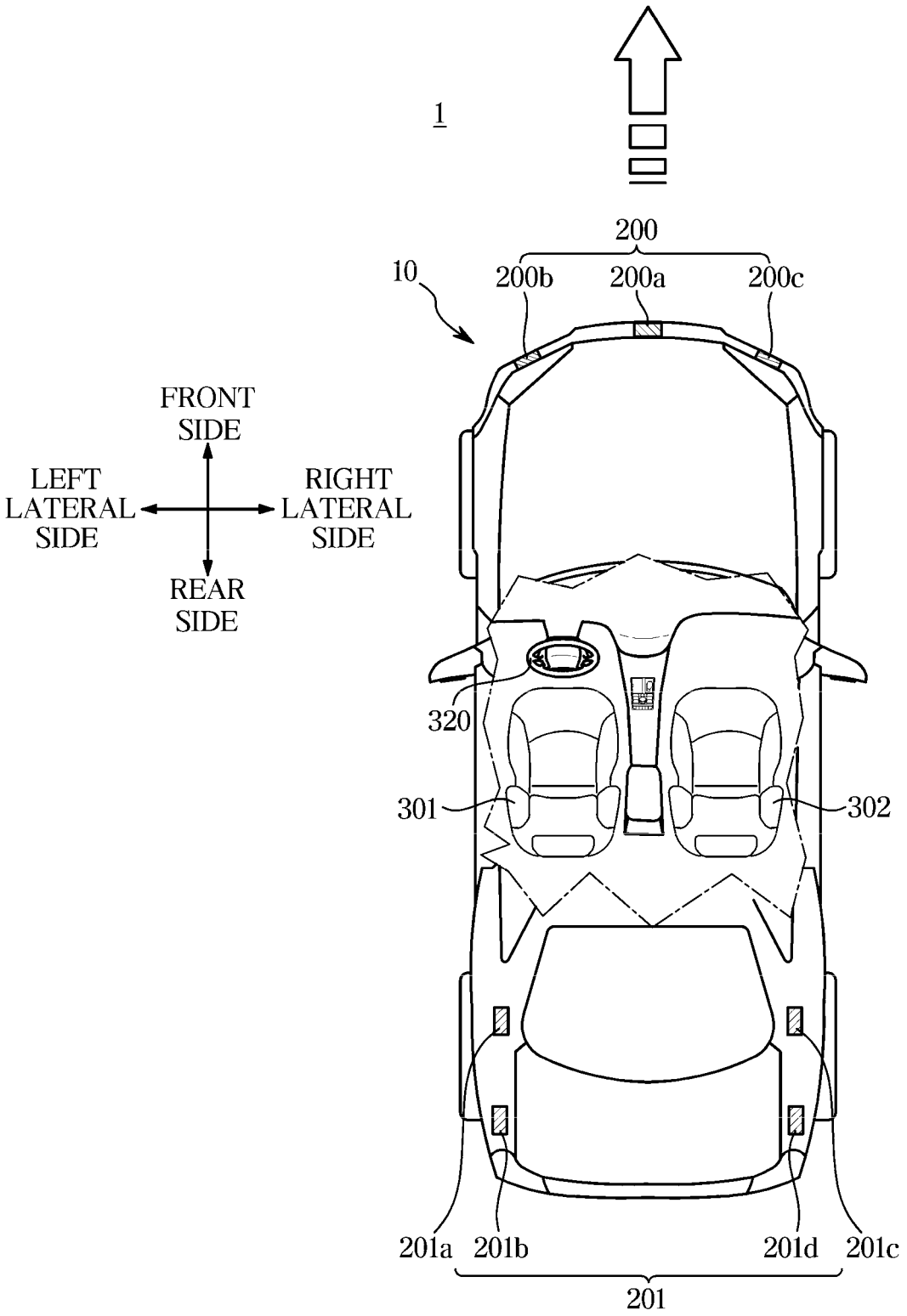
FIG. 1 is a view illustrating a vehicle provided with a sensor and a rear lateral side sensor according to an embodiment of the present disclosure.

In the following description, like reference numerals refer to like elements throughout the specification. Well-known functions or constructions are not described in detail since they would obscure one or more of the exemplar embodiments with unnecessary detail. Terms such as "unit," "module," "member," and "block" may be embodied as hardware or software. According to embodiments, a plurality of "units," "modules," "members," and "blocks" may be implemented as a single component or a single "unit," "module," "member," and "block" may include a plurality of components.

It will be understood that when an element is referred to as being "connected" to another element, it can be directly or indirectly connected to the other element, wherein the indirect connection includes "connection via a wireless communication network."

When a part "includes" or "comprises" an element, unless there is a particular description contrary thereto, the part may further include other elements, not excluding the other elements.

It will be understood that, although the terms first, second, third, etc., may be used herein to describe various elements, they should not be limited by these terms. These terms are only used to distinguish one element from another element.

As used herein, the singular forms "a," "an" and "the" are intended to include the plural forms as well, unless the context clearly indicates otherwise.

An identification code is used for the convenience of the description but is not intended to illustrate the order of each step. Each step may be implemented in an order different from the illustrated order unless the context clearly indicates otherwise.

The principle and embodiments of the present disclosure will now be described with reference to the accompanying drawings.

FIG. 1 is a view illustrating a vehicle provided with a sensor and a rear lateral side sensor according to an embodiment of the present disclosure.

Hereinafter, for convenience of description, a direction in which a vehicle 1 drives forward may be defined as a front side, and a left direction and a right direction may be defined with respect to the front side. When the front side is a 12 o'clock direction, a 3 o'clock direction or in the vicinity of the 3 o'clock direction may be defined as the right direction and a 9 o'clock direction or in the vicinity of the 9 o'clock direction may be defined as the left direction. A direction opposite to the front side may be defined as a rear side. A bottom direction with respect to the vehicle 1 may be defined as a lower side and a direction opposite to the lower side may be defined as an upper side. Additionally, a surface disposed on the front side may be defined as a front surface, a surface disposed on the rear side may be defined as a rear surface, and a surface disposed on the lateral side may be defined as a side surface. Furthermore, a side surface in the left direction may be defined as a left surface and a side surface in the right direction may be defined as a right surface.

Although not illustrated in FIG. 1, at least one capturer 350 (see FIG. 2) may be provided inside the vehicle 1. The capturer 350 may be a camera, a video camera, an image sensor, or the like and may be configured to capture an image around the vehicle 1 while the vehicle 1 is being driven or stopped, and obtain information related to a type and a position of an object. The object captured in the image around the vehicle 1 may include another vehicle (e.g., a surrounding vehicle), a pedestrian, a bicycle, etc., and may include a moving object or various stationary obstacles.

Figure 2:
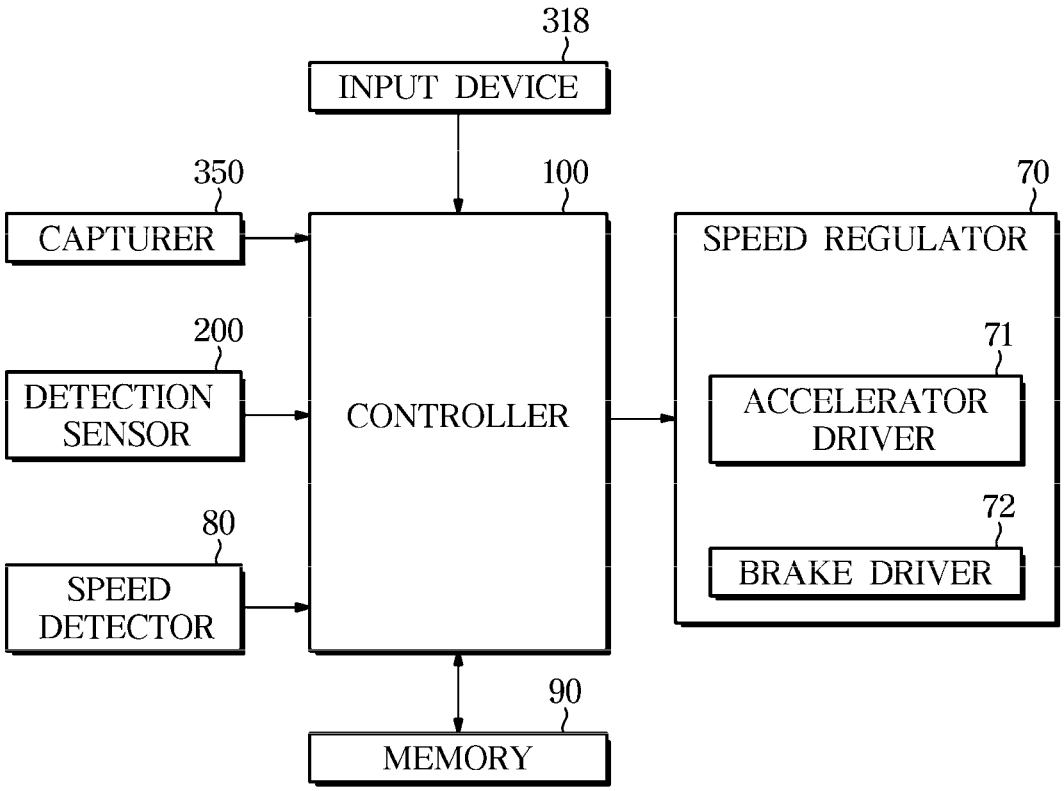
FIG. 2 is a control block diagram of the vehicle according to an embodiment of the present disclosure.

The capturer 350 may be configured to detect the type of the object around the vehicle 1 by capturing the image of the object and identifying a shape of the captured object through image recognition, and may be configured to transmit the detected information to a controller 100 (see FIG. 2).

According to an embodiment, a detection sensor 200 may obtain at least one of position information and driving speed information of the object located around of the vehicle 1 with respect to the vehicle 1. That is, the detection sensor 200 may obtain coordinate information, which changes as the object moves, in real time, and detect a distance between the vehicle 1 and the object.

The controller 100 (see FIG. 2) may calculate a relative distance and a relative speed between the vehicle 1 and the object based on the position and the speed information of the object obtained by the detection sensor 200, and thus the controller 100 may calculate a time to collision (TTC) between the vehicle 1 and the object based on the calculated relative distance and relative speed.

Furthermore, steering to avoid the object may be adjusted based on the position and the speed information of the object obtained by the detection sensor 200.

As illustrated in FIG. 1, the detection sensor 200 may be installed in a position that is appropriate to recognize the object, e.g. another vehicle, in the front, lateral or front lateral side. According to an embodiment, the detection sensor 200 may be installed in all of the front, the left and the right side of the vehicle 1 to recognize the object in all of the front side of the vehicle 1, a direction between the left side and the front side (hereinafter, referred to as "front left side") of the vehicle 1 and a direction between the right side and the front side (hereinafter, referred to as "front right side") of the vehicle 1.

For example, a first detection sensor 200*a* may be installed as a part of a radiator grill 6, e.g., inside of the radiator grill 6, or alternatively the first detection sensor 200*a* may be installed in any position of the vehicle 1 suitable for detecting another vehicle located in front of the vehicle 1. However, according to an embodiment, it will be described that the first detection sensor 200*a* is installed in the center of the front surface of the vehicle. A second detection sensor 200*b* may be installed in the left side of the vehicle 1, and a third detection sensor 200*c* may be installed in the right side of the vehicle 1.

The detection sensor 200 may include a rear lateral side sensor 201 configured to detect a pedestrian or another vehicle that is present in or approaching from the rear side, lateral side or a direction between the lateral side and the rear side (hereinafter referred to as "rear lateral side"). As illustrated in FIG. 1, the rear lateral side sensor 201 may be installed in a position that is appropriate to recognize the object, e.g. another vehicle, on the lateral side, the rear side or the rear lateral side.

The detection sensor 200 may be implemented by using a variety of devices, e.g., a radar using millimeter waves or microwaves, Light Detection And Ranging (LiDAR) using pulsed laser light, a vision sensor using visible light, an infrared sensor using infrared light, or an ultrasonic sensor using ultrasonic waves. The detection sensor 200 may be implemented by using any one of the radar, the Light Detection And Ranging (LiDAR), the vision sensor, the infrared sensor, or the ultrasonic sensor or by combining them. When a plurality of the detection sensors 200 is provided in the vehicle 1, each of the detection sensors 200 may be implemented by using the same type of sensor or different type of sensor. The implementation of the detection sensor 200 is not limited thereto, and the detection sensor 200 may be implemented by using a variety of devices and a combination thereof which is considered by a designer.

Furthermore, a display may be installed on an upper panel of a dashboard (not shown) of the vehicle 1. The display may be configured to output a variety of information in the form of images to a driver or passengers of the vehicle 1. For example, the display may be configured to visually output various information, such as maps, weather, news, various moving or still images, information regarding a status or operation of the vehicle 1, e.g., information regarding an air conditioner, etc. The display may also be configured to provide the driver or the passengers with an alert corresponding to a level of danger to the vehicle 1 (e.g., notification regarding a collision risk).

A center fascia (not shown) may be installed in the middle of the dashboard, and may include an input device 318 (see FIG. 2) for receiving various instructions related to the vehicle 1. The input device 318 may be implemented with mechanical buttons, switches, knobs, touch pad, touch screen, stick-type manipulation device, trackball, or the like. The driver may control many different operations of the vehicle 1 by manipulating the input device 318.

A control stand and an instrument panel are provided in front of a driver's seat. The control stand may be rotated in a particular direction by manipulation of the driver, and accordingly, front or back wheels of the vehicle 1 may be rotated, thereby steering the vehicle 1. The control stand may include a spoke linked to a rotational shaft and a steering wheel coupled with the spoke. On the spoke, there may be an input for receiving various instructions, and the input may be implemented with mechanical buttons, switches, knobs, touch pad, touch screen, stick-type manipulation device, trackball, or the like.

FIG. 2 is a control block diagram of the vehicle according to an embodiment.

Figure 3A:
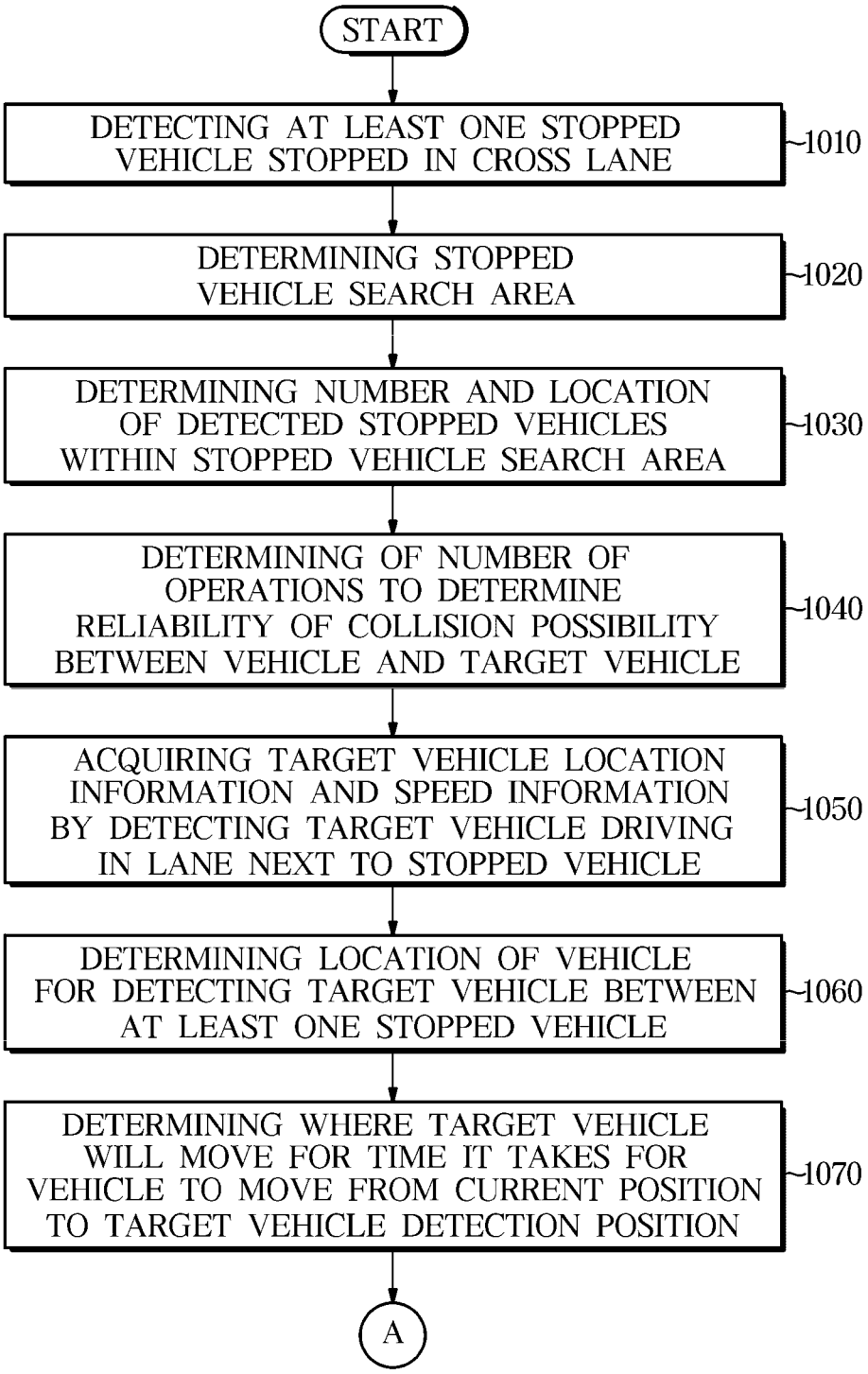
FIGS. 3A and 3B is a flowchart illustrating a method for controlling the vehicle according to an embodiment of the present disclosure.
Figure 3B:
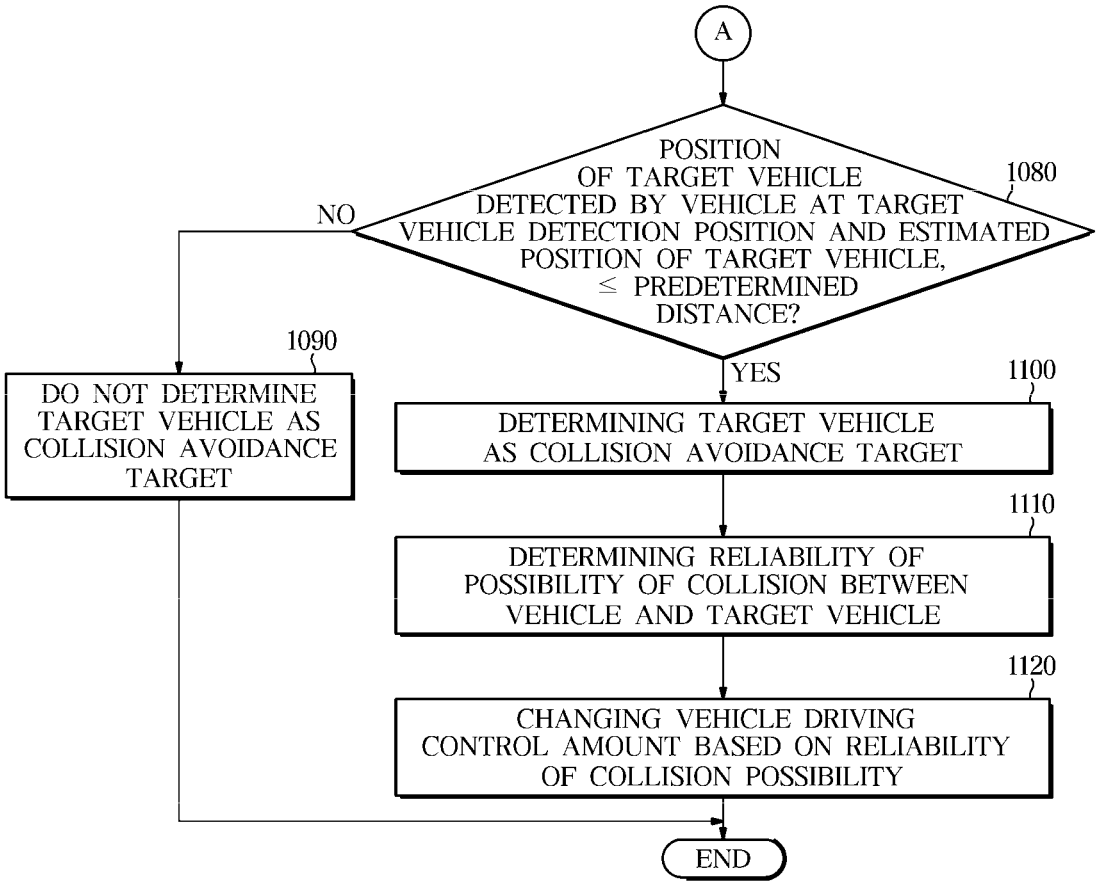
Figure 4:
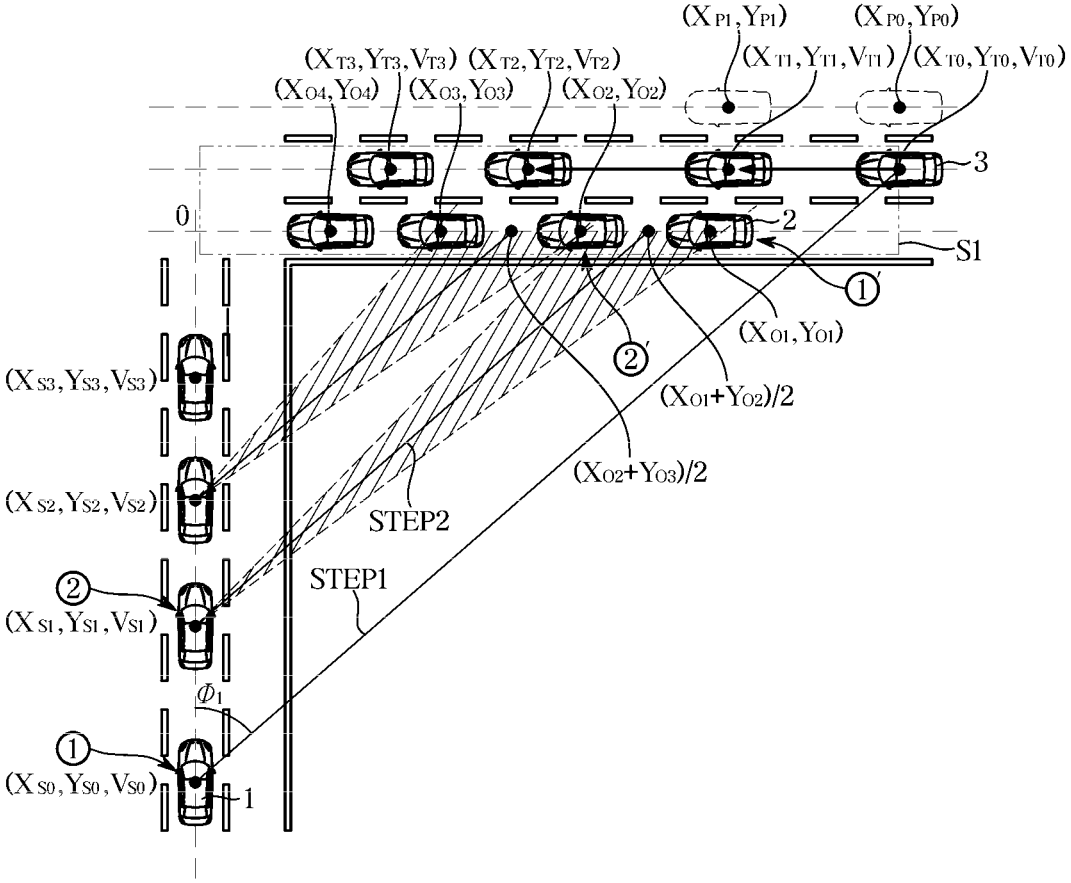
FIGS. 4 and 5 are conceptual diagrams of Cross Collision Avoidance operating according to an embodiment of the present disclosure.
Figure 5:
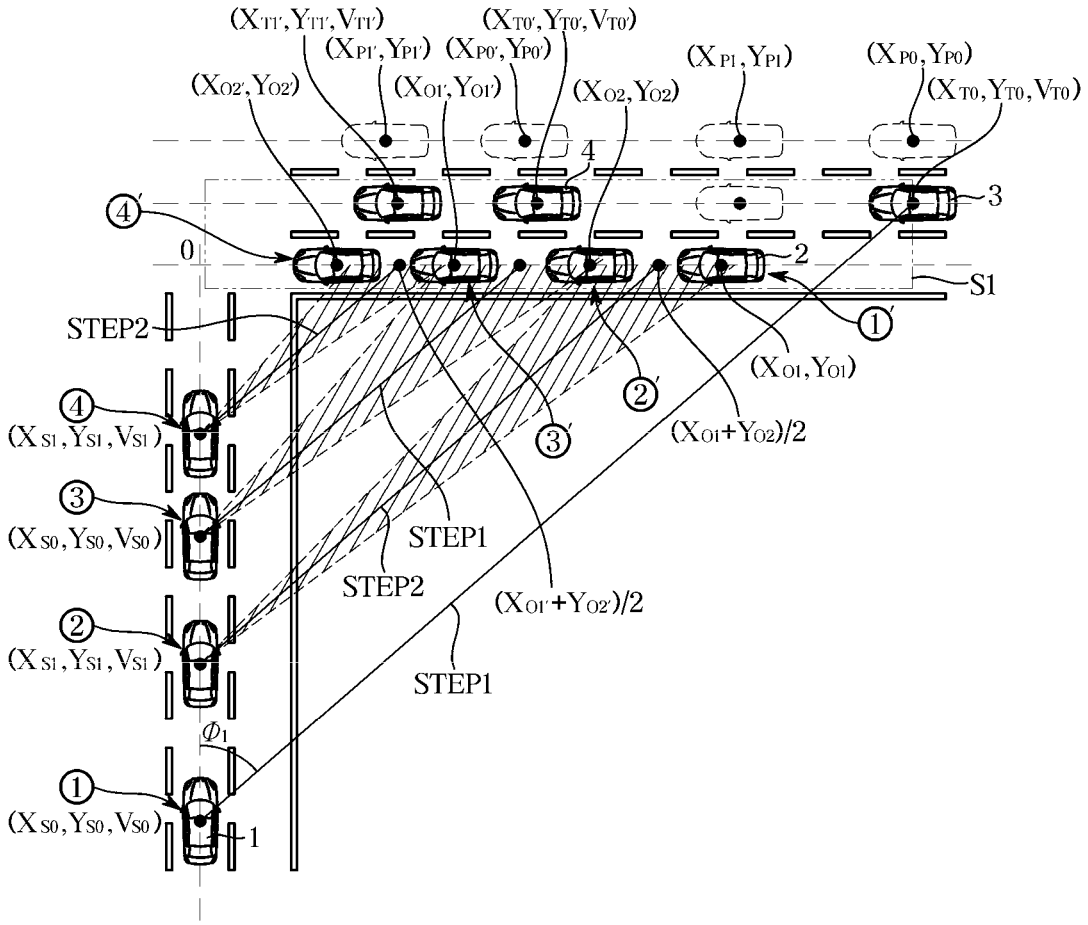

FIGS. 3A and 3B are a flowchart illustrating a method for controlling the vehicle according to an embodiment. FIGS. 4 and 5 are conceptual diagrams of Cross Collision Avoidance operating according to an embodiment.

Referring to FIG. 2, the vehicle 1 may include a speed regulator 70 configured to regulate a driving speed of the vehicle 1 driven by the driver, a speed detector 80 configured to detect the driving speed of the vehicle 1, a memory 90 configured to store data related to the control of the vehicle 1, and the controller 100 configured to control each component of the vehicle 1 and the driving speed of the vehicle 1.

The speed regulator 70 may regulate the speed of the vehicle 1 driven by the driver. The speed regulator 70 may include an accelerator driver 71 and a brake driver 72.

The accelerator driver 71 may increase the speed of the vehicle 1 by operating an accelerator in response to the control signal of the controller 100. The brake driver 72 may reduce the speed of the vehicle 1 by operating the brake in response to the control signal of the controller 100.

The controller 100 may increase or decrease the driving speed of the vehicle 1 to increase or decrease the distance between the vehicle 1 and the object based on the distance between the vehicle 1 and the object and a predetermined reference distance stored in the memory 90.

The controller 100 may also calculate the time to collision (TTC) between the vehicle 1 and the object based on the relative distance and the relative speed between the vehicle 1 and the object, and may transmit a signal controlling the driving speed of the vehicle 1 to the speed regulator 70 based on the calculated TTC.

In addition, the controller 100 may control the brake driver 72 to perform deflected braking of the inner or outer wheels of the wheels of the vehicle 1. That is, the controller 100 may control to assist in steering avoidance through the deflected braking when the vehicle 1 steers around the object.

The speed regulator 70 may regulate the driving speed of the vehicle 1 under the control of the controller 100. When the risk of collision between the vehicle 1 and another object is high, the speed regulator 70 may decrease the driving speed of the vehicle 1.

The speed detector 80 may detect the driving speed of the vehicle 1 driven by the driver under the control of the controller 100. That is, the speed detector 80 may detect the driving speed by using a rotation speed of the vehicle wheel, wherein the driving speed may be expressed as [kph], and a distance (km) traveled per unit time (h).

A steering angle detector (not shown) may detect a steering angle, which is a rotation angle of the steering wheel while the vehicle 1 is driven, and a yaw rate detector (not shown) may detect a speed at which the rotation angle of the vehicle body changes while the vehicle 1 is driving.

The memory 90 may store various data related to the control of the vehicle 1. Particularly, according to an embodiment, the memory 90 may store information related to the driving speed, a driving distance, and a driving time of the vehicle 1, and further store the type and the position information of the object detected by the capturer 350.

The memory 90 may store the position information and the speed information of the object detected by the detection sensor 200 and may store coordinate information of the moving object that is changed in real time. The memory 90 may store information related to the relative distance and the relative speed between the vehicle 1 and the object.

The memory 90 may store data related to equations and control algorithms for controlling the vehicle 1, and the controller 100 may transmit a control signal for controlling the vehicle 1 in accordance with the equations and the control algorithms.

The memory 90 may also store information regarding a steering-based avoidance path established for the vehicle 1 to avoid a collision with the object located in front of the vehicle 1 and information regarding the rotation angle of the steering wheel obtained by the steering angle detector and yaw rate information detected by the yaw rate detector.

In addition, when the controller 100 obtains the position information of the stopped vehicle stopping at the intersection and the position information and the speed information of the target vehicle approaching the intersection according to an embodiment of the present disclosure, the obtained information may be stored in the memory 90.

The controller 100 may control collision avoidance with the target vehicle driving in the lane next to the stopped vehicle based on the data stored in the memory 90.

The memory 90 may be implemented using at least one of a non-volatile memory element, e.g., a cache, Read Only Memory (ROM), Programmable ROM (PROM), Erasable Programmable ROM (EPROM), Electrically Erasable Programmable ROM (EEPROM) and a flash memory; a volatile memory element, e.g., Random Access Memory (RAM); or a storage medium, e.g., Hard Disk Drive (HDD) and CD-ROM. The implementation of the storage is not limited thereto. The memory 90 may be a memory that is implemented by a separate memory chip from the aforementioned processor related to the controller 100 or the storage may be implemented by a single chip with the processor.

The controller 100 may be a computer, processor, central processing unit, an electronic control unit, etc.

FIGS. 3 to 5 describe a method for controlling the vehicle in accordance with an exemplary embodiment of the present disclosure.

The capturer 350 of the vehicle 1 may detect at least one stopped vehicle 2 stopping at a lane crossing the right side of the lane in which the vehicle 1 is driving (1010).

As shown in FIG. 4, when a plurality of the stopped vehicles 2 are stopped in a lane that intersects the right side of the lane in which the vehicle 1 is driving, a target vehicle 3 that drives in the lane next to a stopped vehicle 2 may not be detected by covering the stopped vehicle 2. As a result, there is a risk that the vehicle 1 does not avoid collision with the target vehicle 3 when the vehicle 1 drives without detecting the target vehicle 3.

Therefore, according to a control method of the vehicle 1 according to an embodiment, based on the position information and the speed information of the target vehicle 3 detected between stopped vehicles 2, a collision between the vehicle 1 and the target vehicle 3 can be avoided.

The controller 100 may determine a stopped vehicle search area S1 based on the width of the lane in which the at least one stopped vehicle 2 is located and the side lane of the stopped vehicle 2 (1020), and may determine the number and location of stopped vehicles 2 detected in the stopped vehicle search area S1 (1030).

The stopped vehicle search area S1 is an area for setting the area where the at least one stopped vehicle 2 is stopped in a lane that intersects the right side of the lane in which the vehicle 1 is driving, and it is the area for controlling collision avoidance with an entered target vehicle 2 when the target vehicle 2 traveling in the lane next to the stopped vehicle 2 enters the stopped vehicle search area S1.

As shown in FIG. 4, the controller 100 may determine the transverse length of the stopped vehicle search area S1 as much as the predetermined length is added to the length in the X-axis direction based on the position of the at least one stopped vehicle 2 that is stopped. In addition, the controller 100 may determine the Y-axis longitudinal length of the stopped vehicle search area S1 based on the width of the lane in which the stopped vehicle 2 is stopped and the width of the driving lane of the target vehicle 3 running in the lane next to the stopped vehicle.

The capturer 350 of the vehicle 1 detects the at least one stopped vehicle 2, and the controller 100 may set the position coordinates of the at least one stopped vehicle 2 based on the information detected by the capturer 350.

That is, as illustrated in FIG. 4, the controller 100 may set the coordinates of each of the stopped vehicles 2 to ($X_{O1}$, $Y_{O1}$) to ($X_{O4}$, $Y_{O4}$) when there are, for example, four stopped vehicles 2.

The controller 100 may determine the number of operations for determining reliability of the possibility of collision between the vehicle 1 and the target vehicle 3 based on the number of the stopped vehicles 2 being stopped (1040).

That is, as will be described later, according to the control method of the vehicle 1 according to an embodiment, the collision avoidance between the vehicle 1 and the target vehicle 3 is controlled based on the position and the speed of the target vehicle 3 sensed between the stopped vehicles 2. Therefore, the number of calculations for determining the reliability regarding collision avoidance control can be determined based on the number of the stopped vehicles 2.

In addition, the controller 100 may determine the reliability of the possibility of collision between the vehicle 1 and the target vehicle 3 by considering whether the collision avoidance target is determined according to the determined number of operations.

The detection sensor 200 of the vehicle 1 may acquire the location information and the speed information of the target vehicle 3 by sensing the target vehicle 3 driving in the lane next to the stopped vehicle 2 (1050).

As illustrated in FIG. 4, when the target vehicle 3 enters the stopped vehicle search area S1, the detection sensor 200 of the vehicle 1 detects the target vehicle 3, and may obtain the location information and the speed information of the target vehicle 3 as ($X_{T0}$, $Y_{T0}$, $V_{T0}$).

In addition, when the vehicle 1 detects the target vehicle 3, the controller 100 may determine the location information and the speed information of the vehicle 1 as ($X_{S0}$, $Y_{S0}$, $V_{S0}$).

The controller 100 may determine the position of the vehicle 1 for the vehicle 1 to detect the target vehicle 3 between the stopped vehicles 2 based on the position information of the at least one stopped vehicle 2 (1060).

If the vehicle 1 is initially in position ① ($X_{S0}$, $Y_{S0}$), when the angle between the driving direction of the vehicle 1 and the direction in which the vehicle 1 detects the target vehicle 3 through the detection sensor 200 is Ø1, the controller 100 may determine the position of the vehicle 1 for detecting the target vehicle 3 between the stopped vehicles 2 based on the Ø1 angle.

That is, referring to FIG. 4, when the stopped vehicles 2 are stopped at position ①' and position ②', respectively, in order for the vehicle 1 to detect the target vehicle 3 between the stopped vehicles 2, the vehicle 1 must move from position ① to position ②. Therefore, the controller 100 determines Y coordinate $Y_{S1}$ according to Equation 1 when the vehicle moves to position ② based on the position coordinates of the stopped vehicle 2 stopping at position ①' and position ②'.

$$Y_{S1}=((X_{O1}+X_{O2})/2)/\tan(Ø_1) \quad \text{[Equation 1]}$$

The controller 100 may determine time $T_{S1}$ for the vehicle 1 to move from position ① to position ② based on the Y-axis position coordinates of the vehicle 1 according to Equation 2.

$$T_{S1}=(Y_{S0}-Y_{S1})/V_{S0} \quad \text{[Equation 2]}$$

As mentioned above, when the target vehicle 3 enters the stopped vehicle search area S1, assuming the position coordinates ($X_{T0}$, $Y_{T0}$) of the target vehicle 3 detected by the detection sensor 200 is the initial expected position ($X_{P0}$, $Y_{P0}$) of the target vehicle 3, the controller determines, according to Equation 3, an expected position to which the target vehicle is expected to move during the time the vehicle moves from position ① to position ② based on the moving time of the vehicle and the driving speed of the target vehicle determined by Equation 2 below (1070).

$$X_{P1}=X_{P0}-(V_{T0}*T_{S1}) \quad \text{[Equation 3]}$$

That is, the expected position of the target vehicle 3 that has moved during the time $T_{S1}$ may be determined as ($X_{P1}$, $Y_{P1}$) according to Equation 3.

The vehicle 1 can travel from position ① ($X_{S0}$, $Y_{S0}$) at $V_{S0}$ and reach position ② ($X_{S1}$, $Y_{S1}$), and the detection sensor 200 of the vehicle 1 may detect the target vehicle 3 between the stopped vehicles 2 stopped at position ②. The target vehicle 3 may move during the time $T_{S1}$, and the detection sensor 200 of the vehicle 1 may detect the target vehicle 3 to obtain location information ($X_{T1}$, $Y_{T1}$) of the target vehicle 3. In addition, the detection sensor 200 may obtain driving speed information $V_{T1}$ of the target vehicle 3.

That is, the position information ($X_{T1}$, $Y_{T1}$) and the driving speed information $V_{T1}$ obtained by the detection sensor 200 of the vehicle 1 detecting the target vehicle 3 is the actual information about the position of the target vehicle 3.

The controller 100 may determine the reliability of the possibility of collision between the vehicle 1 and the target vehicle 3 by comparing the expected position ($X_{P1}$, $Y_{P1}$) to which the target vehicle 3 will move with the actual position ($X_{T1}$, $Y_{T1}$) of the target vehicle 3 detected by the detection sensor 200 at position ② (1080) while the vehicle 1 moves from position ① to position ②.

If the difference between $X_{P1}$, which is the X-axis coordinate of the expected position of the target vehicle 3, and $X_{T1}$, which is the X-axis coordinate of the actual position of the target vehicle 3, is less than or equal to a predetermined distance, the controller 100 may determine the target vehicle 3 as the collision avoidance target of the vehicle 1.

That is, when the predicted position predicted that the target vehicle 3 also moves while the vehicle 1 moves from position ① to position ②, and the actual position where the target vehicle 3 moves and is located within a predetermined error range, since the target vehicle 3 is moving according to the speed and the position predicted by the vehicle 1, the vehicle 1 may determine the target vehicle 3 as the collision avoidance target (1100).

The vehicle 1 may detect the target vehicle 3 between the stopped vehicles 2 stopping at a lane crossing at the right side of the lane in which the vehicle 1 is driving, when the vehicle 1 first detects the target vehicle 3 and moves for a predetermined time to detect the same target vehicle 3 between the stopped vehicles 2, the target vehicle 3 is selected as the collision avoidance target.

On the other hand, if the difference between the X-axis coordinate $X_{P1}$ of the expected position of the target vehicle 3 and the X-axis coordinate $X_{T1}$ of the actual position of the target vehicle 3 exceeds the predetermined distance, the controller may not determine the target vehicle 3 as the collision avoidance target of the vehicle 1 (1090).

That is, when the vehicle 1 first detects the target vehicle 3 and moves for the predetermined time, the actual position of the detected target vehicle 3 is not within the predetermined position and the predetermined error range, and since the actual driving speed of the target vehicle 3 is faster or slower than the driving speed of the target vehicle 3 predicted by the vehicle 1 for collision prevention, the controller may not determine that the vehicle 1 is the collision avoidance target of the target vehicle 3.

As shown in FIG. 4, the vehicle 1 detects the target vehicle 3 at position ①, moves for the time $T_{S1}$ and the target vehicle 3 is detected between the stopped vehicles 2 at position ②, and when the detected difference between the actual position $X_{T1}$ of the target vehicle 3 and the predicted position $X_{P1}$ of the target vehicle 3 is within the predetermined error range, the controller 100 determines the target vehicle 3 as the target to prevent collision with the vehicle 1.

That is, the controller 100 may determine the first position of the vehicle 1 for detecting the target vehicle 3 as the first position between the stopped vehicles 2, and the controller may determine the position at which the vehicle 1 reaches to detect the target vehicle 3 between the stopped vehicles 2 by driving for the predetermined time from the first position as the second position.

In FIG. 4, position ① of the vehicle 1 may be the first position, and position ②, which is a position reached between the stopped vehicles 2 to detect the target vehicle 3, may be the second position.

That is, the controller 100 detects the target vehicle 3 between the stopped vehicles 2 at the first position of the vehicle 1, and if the target vehicle 3 is detected between the stopped vehicles 2 at the second position of the vehicle 1, the controller 100 may determine the target vehicle 3 as the collision avoidance target of the vehicle 1.

In contrast, referring to FIG. 5, although the vehicle 1 detects the target vehicle 3 at position ①, when the target vehicle 3 is not detected between the stopped vehicles 2 at position ② moving for the time $T_{S1}$, the target vehicle 3 may not be determined as the collision avoidance target of the vehicle 1.

That is, when position ① of the vehicle 1 is the first position and position ② is the second position, the target vehicle 3 is detected between the stopped vehicles 2 at the first position of the vehicle 1, if the target vehicle 3 is not detected between the stopped vehicles 2 at the second position, the target vehicle 3 is not determined as the collision avoidance target of the vehicle 1.

The vehicle 1 may move from position ② to position ③ for the predetermined time to detect another target vehicle 4 between the stopped vehicle at position ②' and the stopped vehicle at position ③'. At this time, the detected target vehicle 4 is a different target vehicle than the previously detected target vehicle 3.

That is, since the target vehicle 3 detected by the vehicle 1 at position ① is out of the expected position of the target vehicle 3 predicted by the vehicle 1 through acceleration or deceleration during the time $T_{S1}$, the controller 100 does not determine the target vehicle 3 as the collision avoidance target.

The controller 100 releases the collision avoidance target for the target vehicle 3 that was initially detected, for the another target vehicle 4 that the vehicle 1 senses between the stopped vehicle at position ②' and the stopped vehicle at position ③'. At position ③, the controller can repeat the same control algorithm as in FIG. 4.

That is, the controller 100 determines position ④ of the vehicle 1 for detecting the target vehicle 4 between the stopped vehicle 2 at position ③' and the stopped vehicle 2 at position ④', and may determine the predicted position ($X_{P1}'$, $Y_{P1}'$) to which the target vehicle 4 will move during a time $T_{S2}$ for the vehicle 1 to move from position ③ to position ④.

The controller 100 may determine the reliability of the possibility of collision between the vehicle 1 and the target vehicle 4 by comparing the actual position ($X_{T1}'$, $Y_{T1}'$) of the target vehicle 4, when the vehicle 1 has reached position ④ and sensed between the stopped vehicle 2 at position ③' and the stopped vehicle 2 at position ④'.

Referring to FIG. 4, the controller 100 may determine the reliability of the possibility of collision between the vehicle 1 and the target vehicle 2 with respect to the target vehicle 2 determined as the collision avoidance target with the vehicle 1 (1110).

That is, the controller 100 may determine a Crossing Vehicle Existing Flag (CEFn) for the collision avoidance target through the method described above. The CEFn is a value that outputs a flag as "0" or "1" to determine the target vehicle 3 as the collision avoidance target when the difference between the expected position to which the target vehicle 3 moves while the vehicle 1 moves and the actual position of the target vehicle 3 detected at the position at which the vehicle 1 moves is less than or equal to the predetermined distance.

The controller 100 may set the flag to "1" when the target vehicle 3 is determined as the collision avoidance target, and may set the flag to "0" when the target vehicle 3 is not determined as the collision avoidance target.

The controller 100 may determine a cross vehicle existence index (CEI) in order to determine the reliability of the possibility of collision for the target vehicle 3, which is at risk of collision by crossing the vehicle 1 driving in the intersection, based on the crossing vehicle existing flag (CEFn) value.

That is, as the target vehicle 3 approaches the intersection in the lateral direction, the risk of collision with the vehicle 1 increases, and the controller may determine the cross vehicle existence index by giving greater weight as the target vehicle 3 approaches in the lateral direction.

The controller 100 may calculate the cross vehicle existence index (CEI) according to Equation 4.

$$CEI = \sum_{k=1}^{m} CEF_k \times 0.4 \times \frac{k}{m} \quad \text{[Equation 4]}$$

At this time, m=(number of stopped vehicles−1), and 0.4 is a preset constant value for obtaining the cross vehicle existence index (CEI). In FIG. 4, for example, m=3 when there are four stopped vehicles 2 in the intersecting lane. In FIG. 4, if the target vehicle 3 driving in the lane next to the stopped vehicles 2 is detected between the stopped vehicles 2 as the vehicle 1 moves and is the collision avoidance target of the vehicle 1, the cross vehicle existence index (CEI) may be determined as follows.

$$CEI=CEF_1\times0.4\times\tfrac{1}{3}+CEF_2\times0.4\times\tfrac{2}{3}+CEF_3\times0.4\times3/3$$

At this time, since $CEF_1$, $CEF_2$, and $CEF_3$ are all 1, CEI=0.8. That is, CEI=0.8 means that the reliability that can collide with the target vehicle 3 driving next to the stopped vehicle 2 stopped in the lane intersecting on the right side of the lane in which the vehicle 1 is driving is 80%. The controller 100 may change the driving control amount of the vehicle 1 based on the reliability of the possibility of collision between the vehicle 1 and the target vehicle 2 determined by the above-described method (1120).

When the collision reliability between the vehicle 1 and the target vehicle 3 determined according to the cross vehicle existence index (CEI) is high, the controller 100 may advance the braking time of the vehicle 1 by controlling the speed regulator 70 of the vehicle 1. That is, the controller 100 may increase the driving speed reduction amount of the vehicle 1 as the risk of collision between the vehicle 1 and the target vehicle 3 increases. Accordingly, the vehicle 1 can be decelerated above a predetermined deceleration amount to avoid collision with the target vehicle 3.

In addition, when the collision reliability between the vehicle 1 and the target vehicle 3 determined according to the cross vehicle existence index (CEI) is high, the controller 100 may warn the driver of the collision risk by advancing the collision risk warning point.

Thus, according to the vehicle and the control method according to an embodiment, there is an effect of increasing the completeness of the intersection collision avoidance control system by accurately predicting the collision between the vehicle 1 and the target vehicle 3 through the information of the target vehicle 3 obtained through the stopped vehicle 2 stopping at the lane where the vehicle 1 intersects with the driving lane.

The embodiments of the present disclosure may be implemented in the form of recording media for storing instructions to be executed by a computer. The instructions may be stored in the form of program codes, and when executed by a processor, may generate program modules to perform operations in the embodiments of the present disclosure. The recording media may correspond to non-transitory computer-readable recording media.

The non-transitory computer-readable recording medium includes any type of recording medium having data stored thereon that may be thereafter read by a computer. For example, it may be ROM, RAM, a magnetic tape, a magnetic disk, a flash memory, an optical data storage device, etc.

Several exemplary embodiments of the present disclosure have thus far been described with reference to the accompanying drawings. It will be obvious to those of ordinary skill in the art that the present disclosure may be practiced in forms other than the exemplary embodiments as described above without changing the technical idea or essential features of the present disclosure. The above exemplary embodiments are only by way of example, and should not be interpreted in a limited sense.

What is claimed is:

1. A vehicle comprising:

a capturer configured to detect at least one stopped vehicle stopped in a first lane crossing at a right side of a second lane in which the vehicle is located;

a detection sensor configured to detect a target vehicle located in a third lane next to the at least one stopped vehicle to obtain position information and speed information of the target vehicle; and a controller configured to:

determine a first position of the vehicle for sensing the target vehicle between stopped vehicles, determine an expected position to move the target vehicle from an actual position for a time it takes for the vehicle to move from the first position to a second position, and determine a reliability of a possibility of collision between the vehicle and the target vehicle by comparing the actual position of the target vehicle and the expected position of the target vehicle.

2. The vehicle of claim 1, wherein the controller is further configured to determine the target vehicle as a collision avoidance target vehicle when a distance between the actual position and the expected position of the target vehicle is less than or equal to a predetermined distance.

3. The vehicle of claim 1, wherein the controller is further configured not to determine the target vehicle as a collision avoidance target vehicle when a distance between the actual position of the target vehicle and the expected position exceeds a predetermined distance.

4. The vehicle of claim 1, wherein the first position is an actual position of the vehicle and the second position of the vehicle is a position to which the vehicle reaches by moving from the first position for a predetermined time.

5. The vehicle of claim 4, wherein the controller is configured to determine the target vehicle as a collision avoidance target vehicle when the target vehicle is detected between stopped vehicles while the vehicle is at the first position or the target vehicle is detected between stopped vehicles while the vehicle is at the second position.

6. The vehicle of claim 4, wherein the controller is configured not to determine the target vehicle as a collision avoidance target vehicle when the target vehicle is detected between stopped vehicles while the vehicle is at the first position and the target vehicle is not detected between stopped vehicles while the vehicle is at the second position.

7. The vehicle of claim 1, wherein the controller is configured to determine the first position of the vehicle based on position information of the at least one stopped vehicle and an angle between the vehicle and the at least one stopped vehicle.

8. The vehicle of claim 1, wherein the controller is further configured to determine a driving speed of the target vehicle.

9. The vehicle of claim 1, wherein the controller is configured to:

determine a number of operations for determining the reliability of the possibility of collision between the vehicle and the target vehicle based on a number of stopped vehicles, and determine the reliability of the possibility of collision between the vehicle and the target vehicle by considering whether a collision avoidance target vehicle is determined according to the number of operations.

10. The vehicle of claim 1, wherein the controller is configured to:

determine a stopped vehicle search area based on the first lane and a width of the third lane, and determine a number and a position of the at least one stopped vehicle detected in the stopped vehicle search area.

11. The vehicle of claim 1, wherein the controller is further configured to change a driving control amount of the vehicle based on the reliability of the possibility of collision.

12. A method for controlling a vehicle comprising:

detecting at least one stopped vehicle stopped in a first lane crossing at a right side of a second lane in which the vehicle is located;

detecting a target vehicle located in a third lane next to the at least one stopped vehicle to obtain position information and speed information of the target vehicle;

determining a first position of the vehicle for sensing the target vehicle between stopped vehicles;

determining an expected position to move the target vehicle from an actual position for a time it takes for the vehicle to move from the first position to a second position; and determining a reliability of a possibility of collision between the vehicle and the target vehicle by comparing the actual position and the expected position of the target vehicle.

13. The method of claim 12, further comprising determining the target vehicle as a collision avoidance target vehicle when a distance between the actual position and the expected position of the target vehicle is less than or equal to a predetermined distance.

14. The method of claim 12, further comprising not determining the target vehicle as a collision avoidance target vehicle when a distance between the actual position and the expected position of the target vehicle exceeds a predetermined distance.

15. The method of claim 12, wherein, in the determining a first position of the vehicle, the first position is an actual position of the vehicle and the second position of the vehicle is a position to which the vehicle reaches by moving from the first position for a predetermined time.

16. The method of claim 15, further comprising determining the target vehicle as a collision avoidance target vehicle when the target vehicle is detected between stopped vehicles while the vehicle is at the first position or the target vehicle is detected between stopped vehicles while the vehicle is at the second position.

17. The method of claim 15, further comprising not determining the target vehicle as a collision avoidance target vehicle when the target vehicle is detected between stopped vehicles while the vehicle is at the first position and the target vehicle is not detected between stopped vehicles while the vehicle is at the second position.

18. The method of claim 12, wherein the determining a first position of the vehicle includes determining the first position of the vehicle based on position information of the at least one stopped vehicle and an angle between the vehicle and the at least one stopped vehicle.

19. The method of claim 12, wherein the determining an expected position includes determining a driving speed of the target vehicle.

20. The method of claim 12, further comprising:

determining a number of operations for determining the reliability of the possibility of collision between the vehicle and the target vehicle based on a number of stopped vehicles; and determining the reliability of the possibility of collision between the vehicle and the target vehicle by considering whether a collision avoidance target vehicle is determined according to the number of operations.

* * * * *